US008088053B2

(12) United States Patent
Whyatt et al.

(10) Patent No.: US 8,088,053 B2
(45) Date of Patent: Jan. 3, 2012

(54) PHYSICAL TRAINING AND REHABILITATIVE ROPE SUSPENSION SYSTEM

(75) Inventors: Khita Whyatt, Ann Arbor, MI (US); Kirsten Sell, Manchester, MI (US)

(73) Assignee: Orenda LLC, Ann Arbor, MI (US)

( * ) Notice: Subject to any disclaimer, the term of this patent is extended or adjusted under 35 U.S.C. 154(b) by 0 days.

(21) Appl. No.: 12/784,836

(22) Filed: May 21, 2010

(65) Prior Publication Data

US 2011/0207586 A1 Aug. 25, 2011

Related U.S. Application Data

(60) Provisional application No. 61/307,548, filed on Feb. 24, 2010.

(51) Int. Cl.
*A63B 21/00* (2006.01)

(52) U.S. Cl. ..... 482/143; 482/23; 482/34

(58) Field of Classification Search ..... 601/108, 601/111–113, 107; 482/80, 81, 82, 91, 110
See application file for complete search history.

(56) References Cited

U.S. PATENT DOCUMENTS 5,518,486 A * 5/1996 Sheeler ..... 482/131

OTHER PUBLICATIONS

Product brochure for Terapi Master, Active treatment and exercise with S.E.T. (Sling Exercise Therapy).

* cited by examiner

*Primary Examiner* — Jerome w Donnelly
(74) *Attorney, Agent, or Firm* — Gifford, Krass, Sprinkle, Anderson & Citkowski, P.C.

(57) ABSTRACT

A physical training and rehabilitation system includes a rope having first and second sides that hang downwardly from a bar, beam or other support, the rope terminating in first and second ends. A locking mechanism having first and second sections receives the first and second rope sides, respectively. Each section of the mechanism is independently adjustable between an unlocked position, wherein the rope side associated with that section can slide through the locking mechanism, and a locked position, wherein the rope side associated with that section is prevented from sliding. A connector disposed at the first end of the rope forms a loop for connection to an attachment or accessory related to a desired activity. The attachments or accessories may include a loop, a sling, a rigid bar, a spring, a support belt, or a handle. The system may be provided in kit form. Methods of assembly and use are also disclosed.

14 Claims, 7 Drawing Sheets

PHYSICAL TRAINING AND REHABILITATIVE ROPE SUSPENSION SYSTEM

REFERENCE TO RELATED APPLICATION

This application claims priority from U.S. Provisional Patent Application Ser. No. 61/307,548 filed Feb. 24, 2010, the entire content of which is incorporated herein by reference.

FIELD OF THE INVENTION

This invention relates generally to physical conditioning and therapy and, in particular, to a system and method for physical training and rehabilitative exercises based upon suspended length-adjustable ropes and attachable accessories.

BACKGROUND OF THE INVENTION

Numerous devices have been devised to make physical conditioning more effective. Such equipment may be directed to many applications, including exercise, stretching, strength training, yoga, Pilates, and other activities.

Some of these systems use ropes or slings. One example of many is the sling exercise therapy or "SET" system originally developed in Norway in the 1960s and sold under the names TherapiMaster or "Redcord." The SET system includes a ceiling-mounted unit from which two ropes extend, each terminating in straps used for suspension. The two ropes can be adjusted for a desired height, enabling different body parts to be suspended for different physical conditioning configurations.

While the SET system does provide for attachable slings and other components, the equipment is quite expensive and limited in terms of reconfiguration capabilities. Thus, the need remains for an economical yet versatile rope suspension system for system for physical training and rehabilitation.

SUMMARY OF THE INVENTION

This invention resides in a system and methods of use directed to physical training, rehabilitation, and other exercise or fitness-related activities. A basic system includes a rope having first and second sides that hang downwardly from a bar, beam or other support, the rope terminating in first and second ends. A locking mechanism having first and second sections receives the first and second rope sides, respectively. Each section of the mechanism is independently adjustable between an unlocked position, wherein the rope side associated with that section can slide through the locking mechanism, and a locked position, wherein the rope side associated with that section is prevented from sliding. A connector disposed at the first end of the rope forms a loop for connection to an attachment or accessory related to a desired activity. The attachments or accessories may include a loop, a sling, a rigid bar, a spring, a support belt, or a handle.

In the preferred embodiment, each section of the locking mechanism is independently adjustable between an unlocked and locked position with a separate lever, and the connector is a body through which the first end is clamped to form the loop. The system may further include a device such as a Prusik cord to form a moveable loop along the second side of rope for connection to an attachment or accessory. A more comprehensive system may include a pair of ropes, each terminating in a loop-forming connector, and a pair of the locking mechanisms. A suspension device may be provided as part of the system in the form of a bar, beam, eye hooks or pulleys.

The system may be provided in kit form. Such a kit may include at least one rope having first and second sides that terminate in first and second ends, respectively, one of the ends including a loop-forming connector; a locking mechanism having first and second sections to receive the first and second rope sides, respectively, each section being independently adjustable between an unlocked position, wherein the rope side associated with that section can slide through the locking mechanism, and a locked position, wherein the rope side associated with that section is prevented from sliding; at least one snap hook or carabineer; and at least one attachment or accessory configured for coupling to the loop-forming connector using the snap hook or carabineer. The attachments or accessories may include a loop, a sling, a rigid bar, a spring, a support belt, and a handle. To better accommodate some of these and other attachments or accessories, the kit may include a Prusik cord to form a moveable loop along the second side of rope and additional snap hooks or carabineers.

DETAILED DESCRIPTION OF THE INVENTION

Figure 1:
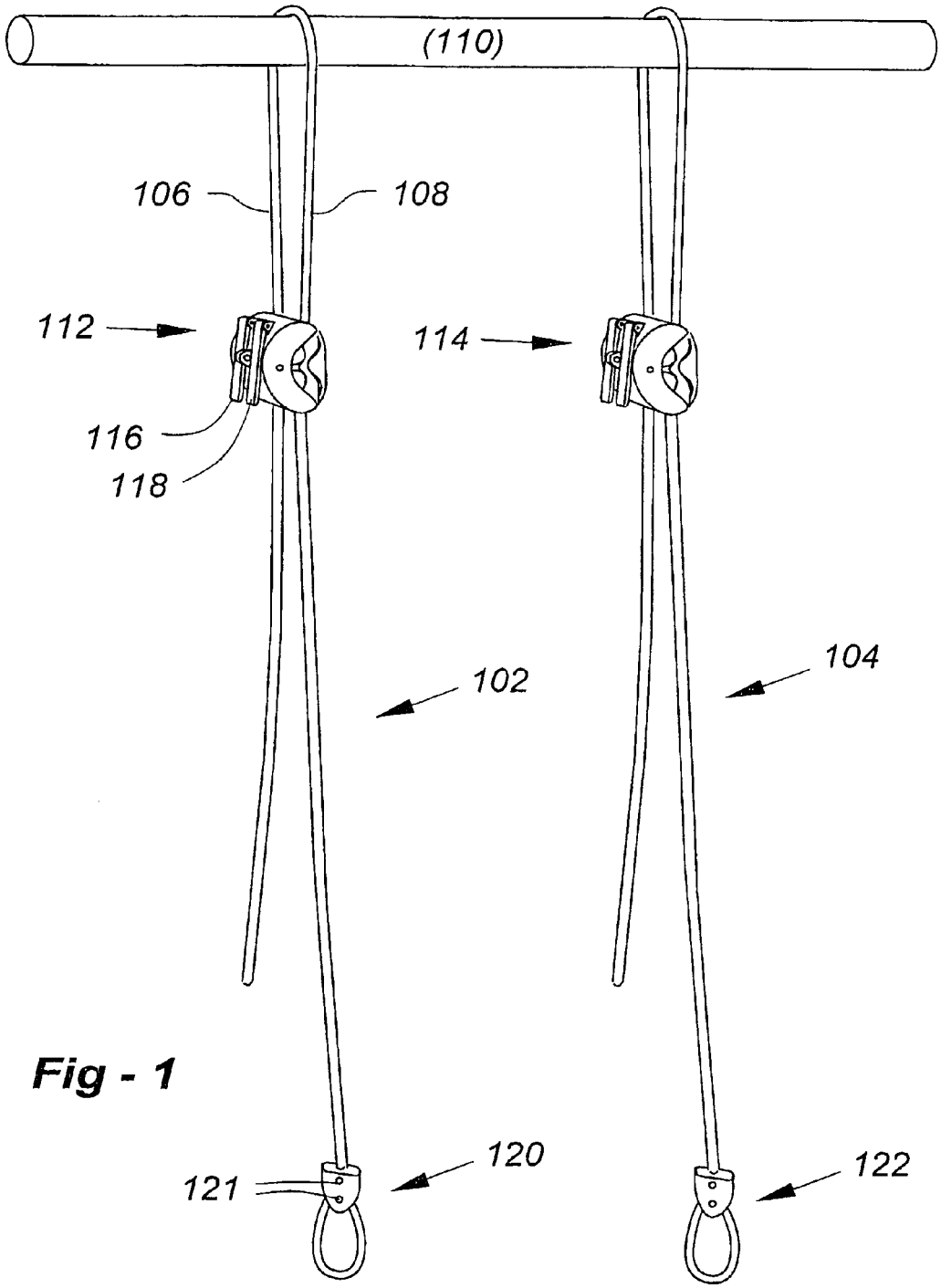
FIG. 1 is a front/side view of a basic embodiment of the invention suspended over a bar without attachments or accessories.

This invention resides in a system and associated methods for physical training and rehabilitative exercises. Making reference to FIG. 1, a basic configuration includes one or two ropes 102, 104 that can be suspended over a bar or beam 110. Each rope may alternatively be suspended over a door, through eye hooks, pulleys, or the like. With appropriate hardware, the suspension system may also be utilized from a frame structure, a wall, a ceiling, over a door, or the like.

Each rope when suspended over a fixed support creates two sides of rope with two independently adjustable rope lengths. For example, in FIG. 1, rope 102 includes length 106 and 108. Each side of rope descends downwardly and passes through a locking mechanism. Continuing the reference to FIG. 1, sides 106, 108 pass through mechanism 112, whereas the sides of rope 104 pass through mechanism 114.

Figure 2A:
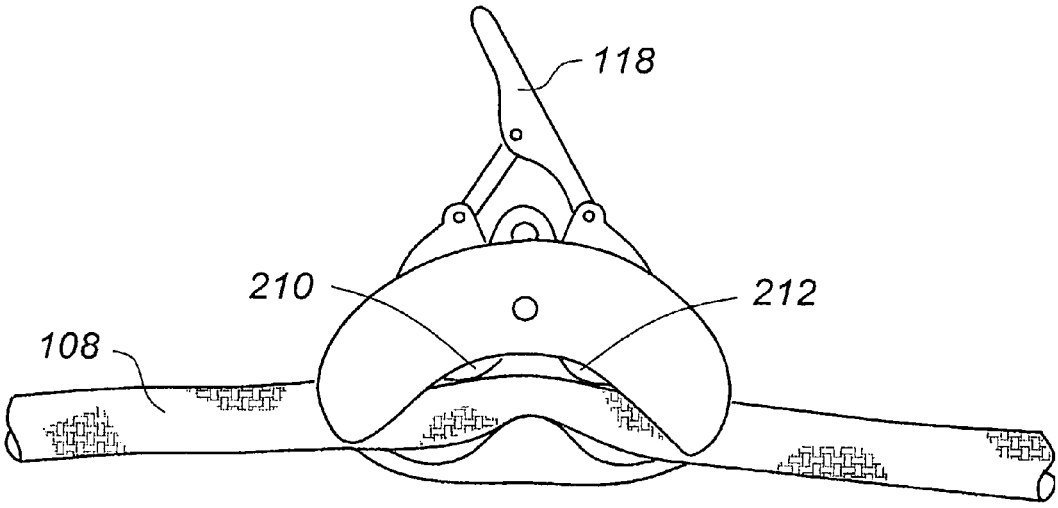
FIG. 2A is a side view of the "Slide-lok" in an open position.
Figure 2B:
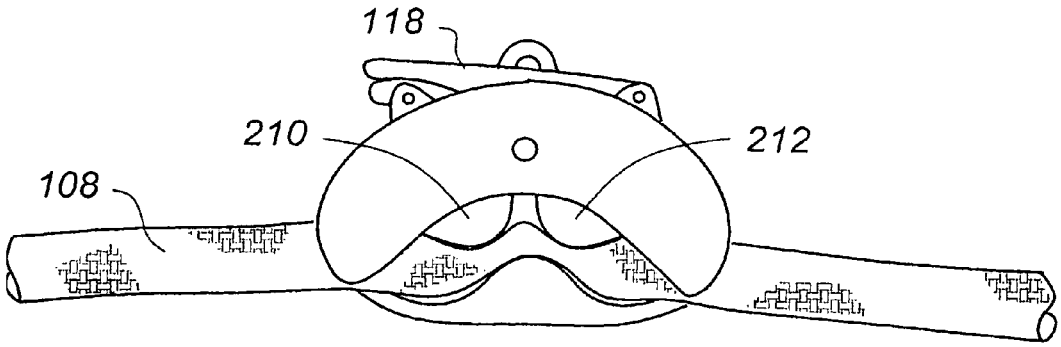
FIG. 2B is a side view of the "Slide-lok" in a closed or locked position.

A presently preferred mechanism is known as the "Slide-lok." Each Slide-lok has two sides, each side operated with a lever. In FIG. 1, levers 116, 118 are associated with the two sides of mechanism 112. Each side has a channel that allows each side of rope to pass through. FIG. 2A is a drawing that illustrates a Slide-lok mechanism with the lever 118 open, whereas FIG. 2B shows the lever 118 closed. Within each channel of the "Slide-lok" there are flanges 210, 212 attached to cams that ensure that the rope does not slide out.

When lever 118 is in a full upright position as shown in FIG. 2A, this allows that side of rope 108 to slide freely back and forth. When lever 118 is in the down position shown in FIG. 2B, the rope 108 is retained in a locked position. Both sides of each mechanism operate in the manner just described, enabling each side of rope to have an independently adjustable lengths. While the mechanism just described is presently preferred, those of skill will recognize that other locking mechanisms may be substituted for the "Slide-lok," so long as the device has two channels that facilitate independent movement, adjustment and locking each side of rope therethrough.

Note that the invention is not limited in terms of rope composition, construction, diameter or length (within practical ranges). Diameters in the range of ¼ inch or less to an inch or greater are possible, depending upon rope length, strength, the size of the user, intended application, and the type of attachments or accessories. Lengths of two (2) feet or less up to sixteen (16) feet or greater are possible, depending upon the height of the suspension, the size of the user, rope strength, intended application, and the type of attachments or accessories. Any suitable type or rope may be used including natural and synthetic materials. Common natural materials include natural fibers such as manila hemp, hemp, linen, cotton, coir, jute, and sisal. Synthetic fibers include polypropylene, nylon, polyesters (e.g. PET, LCP, HPE, Vectran), polyethylene (e.g. Spectra), Aramids (e.g. Twaron, Technora and Kevlar) and polyaramids (e.g. Dralon, Tiptolon). Some ropes may be constructed of mixtures of several different fibers or use co-polymer fibers. Ropes according to the invention can also be made out of metal. Thus, in this disclosure, "rope" should be taken to mean a flexible elongated material having an appropriate length, diameter and composition, including solid, twisted or braided structures, which is capable of providing the requisite strength for supporting, suspending, pulling and connecting in accordance with the invention as described herein.

Referring again to FIG. 1, one end of each side of rope preferably terminates in a "Rope Clamp," 120 for rope 102 and 122 for rope 104. Each "Rope Clamp" forms a strong loop. The loop allows for the use of a snap hook or a carabineer. The snap hook or carabineer is used to connect the various attachments or accessories, as described elsewhere herein.

The "Rope Clamp" has brass threaded inserts that are molded in on half of the clamp and stainless screws that are used to tighten the halves together. Within each "Rope Clamp" there are spikes that pierce and secure each side of rope making it unfeasible for the loop to come apart. It will be appreciated by those of skill that other loop-forming arrangements may be used in lieu of the Rope Clamp, including nut-tightened metal or plastic clamps, thermal welding, glue, braiding, and so forth.

Figure 3:
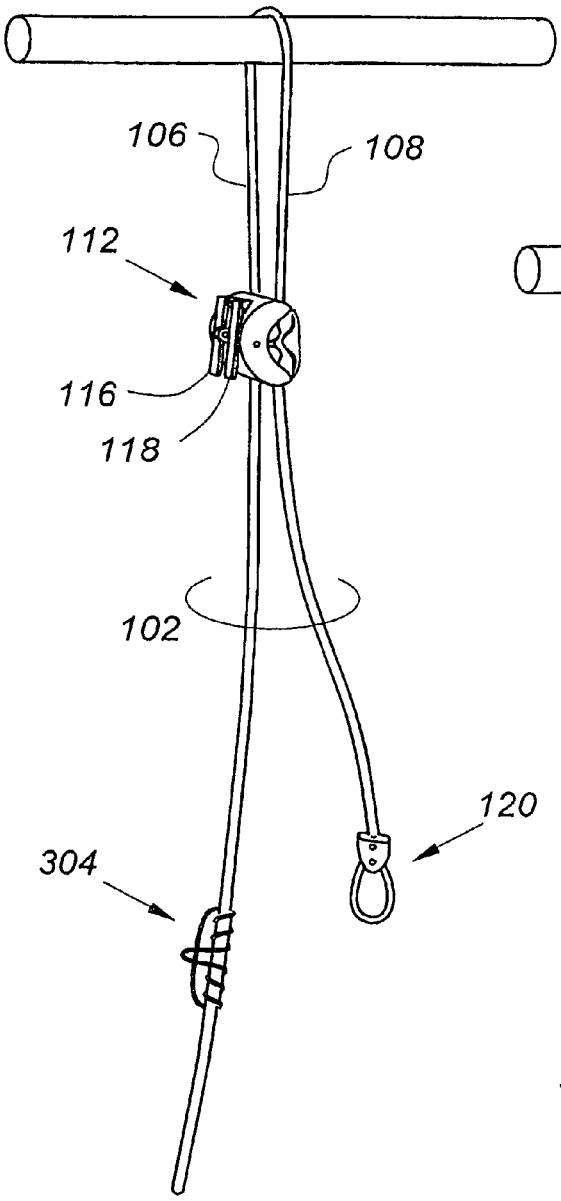
FIG. 3 is a front/side view of a single rope system including a Prusik cord used to create an additional secured loop in the rope.

A kit including a single rope with one side terminating in a fixed loop and a single two-sided adjustment mechanism has numerous useful purposes, particularly when accessories of the types just mentioned are attached to the loop. However, to further enhance versatility, a mechanism may be included to create an additional loop on the second side of the rope that can be easily moved up and down for various attachments. In preferred embodiments, this additional loop is established with a Prusik cord 304 (also called a Prusik knot or Prusik hitch) shown in FIG. 3. FIGS. 4A-4G illustrate steps in forming loop 402 in the Prusik cord. Once formed, it may be loosened and slid to any desired position along the rope to which it is coupled. As with the Rope Clamp, the loop allows for the use of a snap hook or a carabineer to connect the various rope attachments or accessories described herein.

Figure 5A:
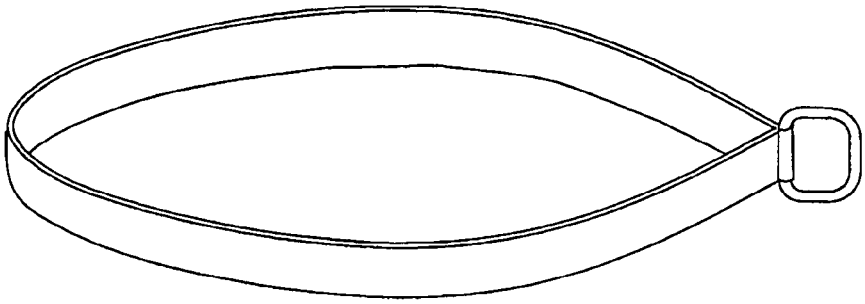
FIG. 5A is a drawing that shows an attachable handle or foot loop accessory.
Figure 5B:
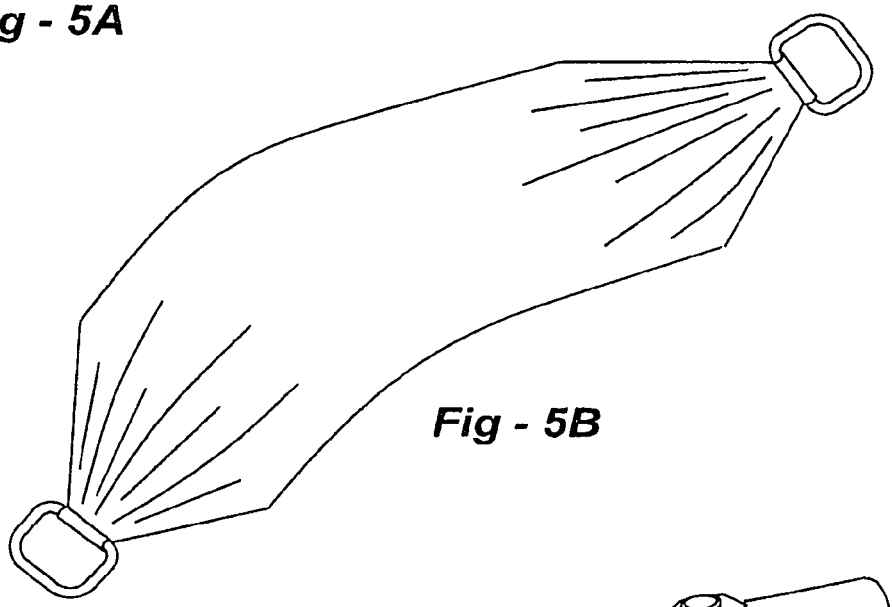
FIG. 5B shows an attachable wide sling accessory.
Figure 5C:
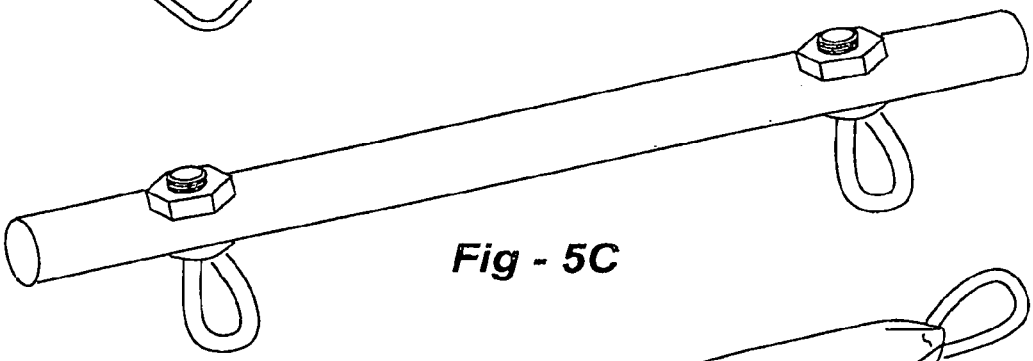
FIG. 5C shows an attachable wooden bar accessory.
Figure 5D:
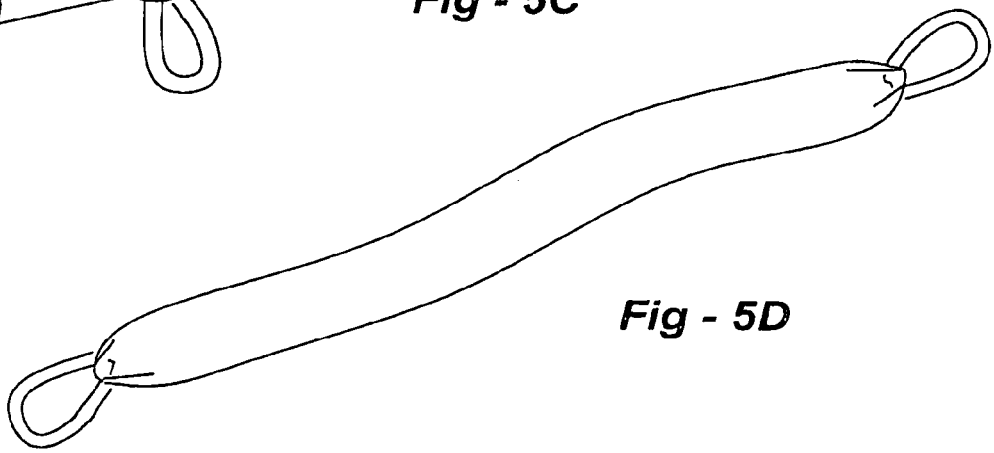
FIG. 5D shows an attachable resistance spring accessory.
Figure 5E:
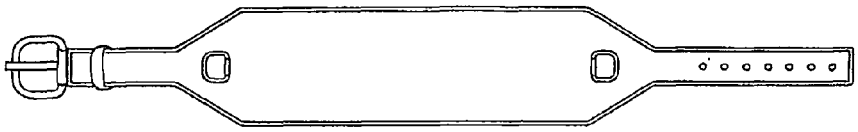
FIG. 5E shows an attachable narrow sling accessory.
Figure 5F:
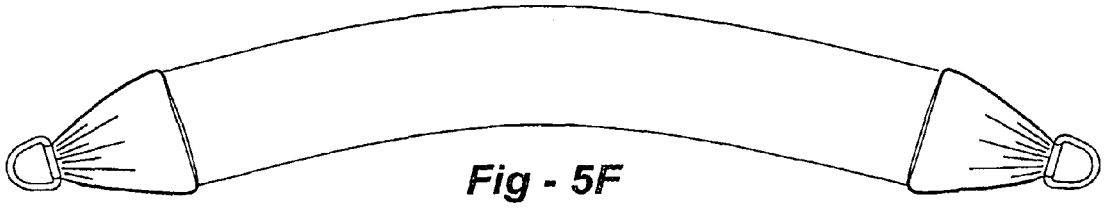
FIG. 5F shows an attachable support belt accessory.
Figure 5G:
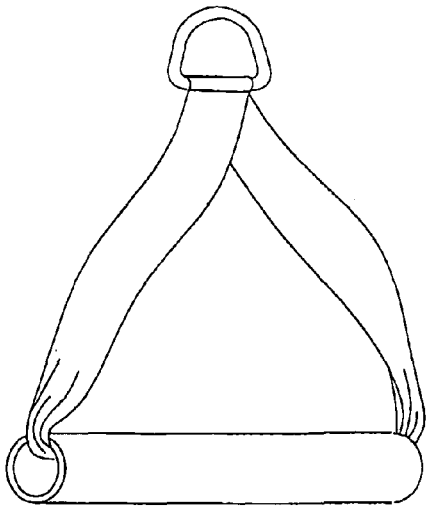
FIG. 5G shows an alternative handle accessory.

The loop formed by the Rope Clamp, and/or the loop 402 formed with the Prusik cord, each allow for a snap hook, carabineer or the like to be attached to the respective side of the rope to connect various attachments or accessories including, but not limited to: a handle or foot loop (FIG. 5A), wide sling (FIG. 5B), wooden bar (FIG. 5C), springs (FIG. 5D), narrow sling (FIG. 5E), support belt (FIG. 5F) and handle (FIG. 5G).

The Physical Training and Rehabilitative Rope Suspension System disclosed herein is intended to be simple to use, portable, and takes up little space. The system was designed to enable the user to strengthen, with resistance, the deep (core) muscles that stabilize the skeleton, maintain space and mobilize the joints, as well as strengthen and stretch the larger muscles that create gross motor movement. The system, though simple, allows the user to move in any plane with static and dynamic resistance from the ropes, springs, or utilizing their own body weight. These movements can be achieved with support from the various attachments or accessories. Therefore, the system will affect all aspects of the body in an unlimited number of movements, planes and ranges of motion.

The system has been designed to work with any user, with or without limitations, to help increase strength and flexibility, mobilize joints, improve performance and technique or assist with any other muscular skeletal challenges. The system can be used to the benefit of anyone from child to geriatric, injured, disabled or athletic. The system is designed for individuals to use at home or portable enough for travel, it is also suitable for multiple systems to be installed in one location or facility for group use. The system will be offered with the attachments or accessories sold separately or as a kit with attachments and accessories tailored to athletic or rehabilitative needs.

Basic System Operation

In use of the system, a user initially drapes the one (1) or two (2) ropes over or through a fixed support, eye bolt or pulley. This allows both sides of one or both ropes to be utilized. Each side of each rope is then inserted into the channel of the "Slide-lok" locking mechanism. The levers of the "Slide-lok" are placed in a down position and the rope is now in a secured locked position.

At this stage the system is assembled and ready to use. As discussed, one end of each side of the rope terminates in a "Rope Clamp" forming a loop arrangement. A snap hook or caribiner is attached to the loop to allow for the various attachments or accessories to be connected to perform the exercise or stretch intended. If a Prusik cord is provided, it may be formed in accordance with FIG. 4 on the other side of the rope, slid into position and tightened to form an additional loop on the other side of the rope. One or both sides of each rope may then be adjusted to the desired height for the specific exercise or movement for that user.

Figure 6:
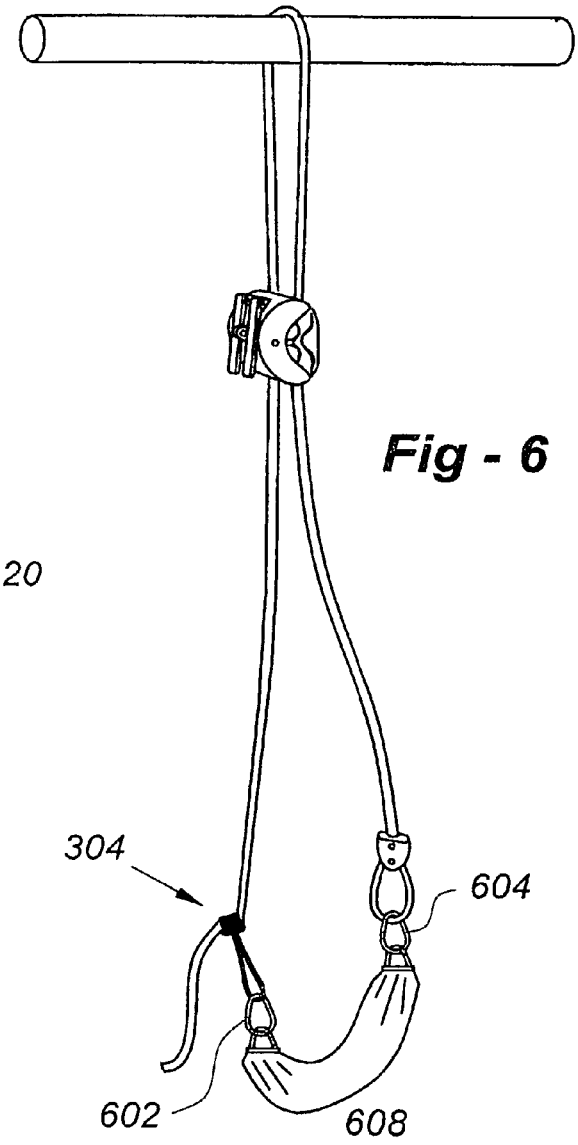
FIG. 6 depicts a rope system with a Prusik cord, a pair of snap hooks or carabineers and a sling prior to use.
Figure 4A:
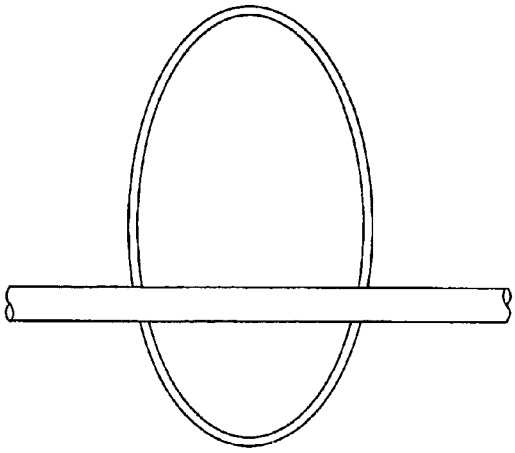
FIG. 4A-4G illustrate steps in forming a Prusik cord.
Figure 4B:
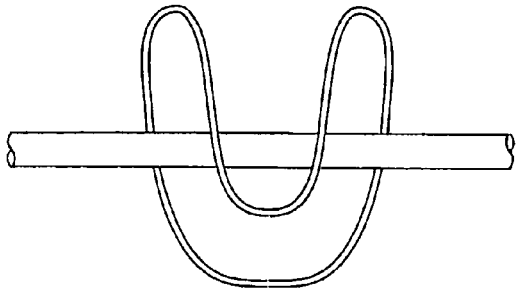
Figure 4C:
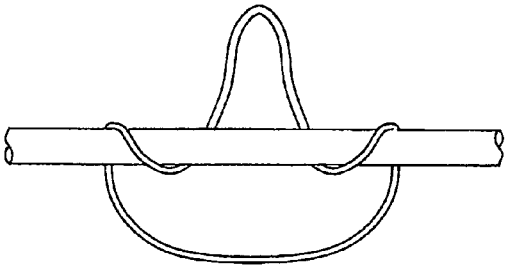
Figure 4D:
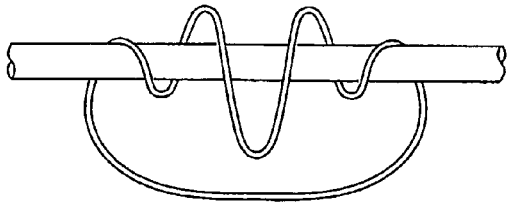
Figure 4F:
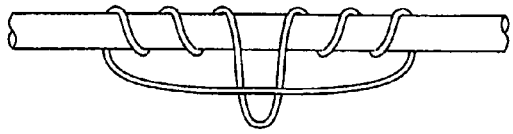
Figure 4E:
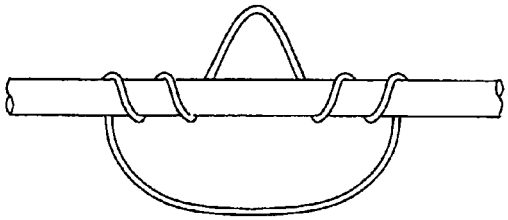
Figure 4G:
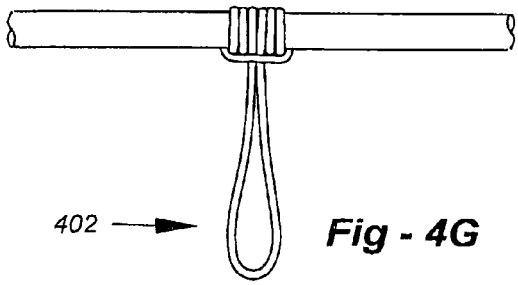

If one (1) rope is being utilized the user may adjust the "Slide-lok" mechanism up to a single anchor point above the user's head. This allows one (1) rope to perform as if using two (2) individual separate ropes. The one (1) rope allows for a one (1), two (2) (or more) attachments or accessories, depending upon the provision of Prusik cords. One (1) or two (2) attachments or accessories can be used for unilateral or bilateral muscle activation. FIG. 6 depicts a (1) rope system with a Prusik cord 304, a pair of snap hooks or carabineers 602, 604 and a sling 606 prior to use.

Figure 7:
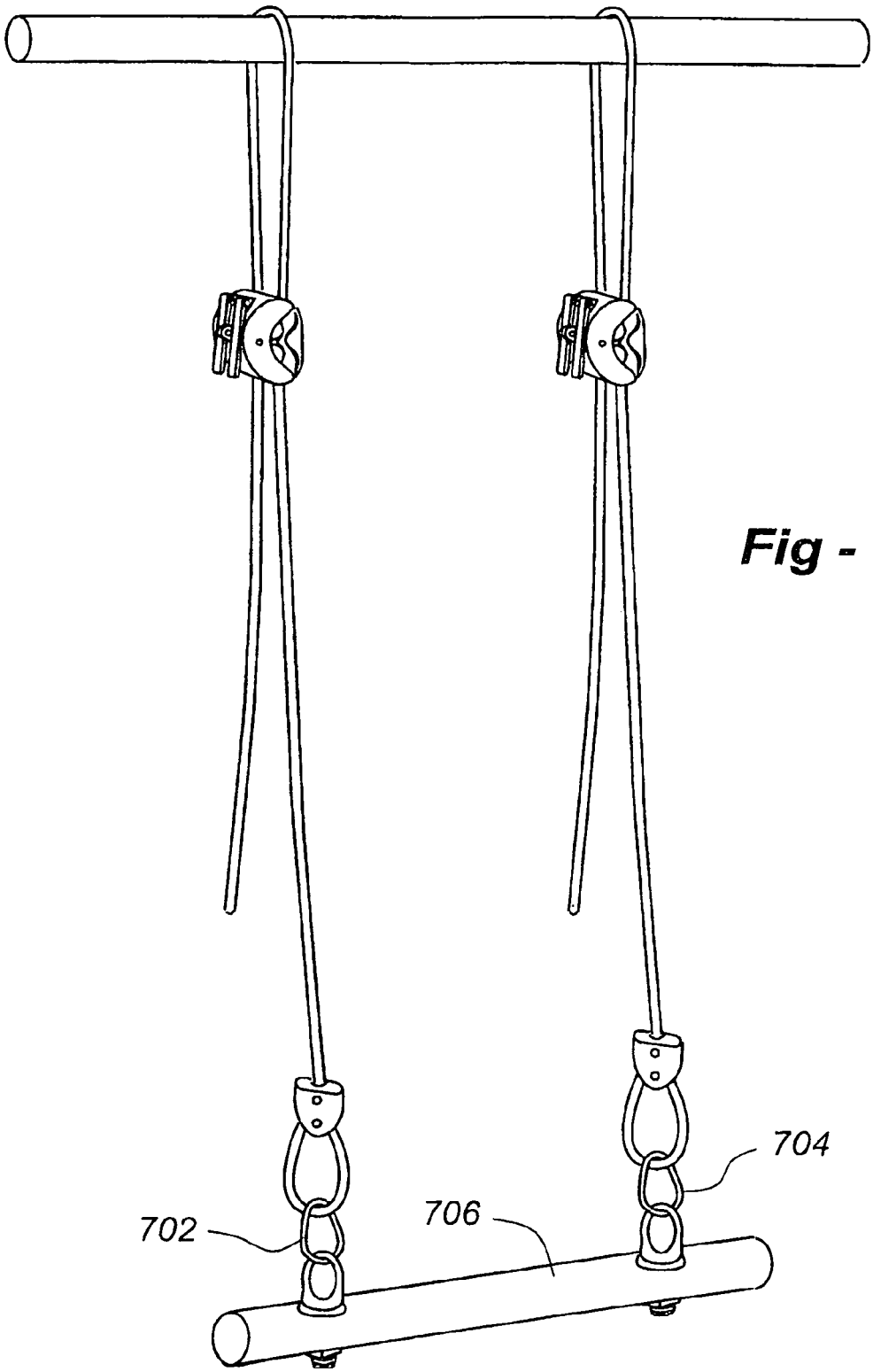
FIG. 7 depicts a rope system with a pair of snap hooks or carabineers and a bar made or wood or other rigid material prior to use.

If two (2) ropes are being utilized, the user can adjust each side of each rope for the desired movement. This allows for more rope length adjustment possibilities and permits lateral spacing flexibility at the anchor points. Lateral spacing flexibility allows for standing exercises and stretches with the anchor points positioned over the top of each joint. When utilizing two (2) ropes, one (1) to four (4) (or more) attachments or accessories can be used at a time with (2) (or more) Prusik cords for an unlimited number of exercises and stretches, in any plane of movement with all four limbs and torso simultaneously. FIG. 7 depicts a (2) rope system with a pair of snap hooks or carabineers 702, 704 and a bar 706 made or wood or other rigid material prior to use.

Alternative Applications

In accordance with the use of the invention, a support belt with 2 ropes could be used for spotting during gymnastics, tumbling or activities that involve twists, flips, and so forth, as would be the case with dancing, cheerleading, trampoline or diving practice. Using one or two ropes with the support belt and pulley option allows the system to be used to teach rock climbing. The pulley would be anchored from above close to the structure being climbed. The system would function in the same manner as a belay system used in mountain climbing or indoor climbing facilities.

Adding a harness or vest to the system allows for a variety of drag resistance explosive drills with dynamic means. Static resistance can be accomplished in the same manner if pulling a weighted object.

Adding a harness or vest to the system, using dynamic means and attaching the system to a base surface allows for a variety of vertical, step quickness and breakaway drills.

The system can be used in water creating drag resistance with springs. The system can be attached to ladder or attached to the side of a pool using eye bolts. The system would utilize a life vest, kick board, support belt or shoulder harness as an attachment or accessory in this application.

The system could be used to practice kicking by attaching a practice ball in mesh bag.

The system can be used to create a children's swing using the sling attachment or accessory.

The system can be used anywhere there is an object to suspend the rope over. The object must be capable of supporting the user's body weight.

Different materials and sizes can be used for all components of the system.

The system allows a user to tie a series knots in the rope to create additional hand holds or to add additional attachments or accessories.

The system can be used in lieu of or in conjunction with a Pilates Trapeze Table.

Partial List of System Advantages

Locking systems allows both sides of two ropes to be adjustable.

Two (2) ropes can be used together or independently.

Using two (2) ropes independently allows for (2) people to use one (1) system.

Two (2) ropes with the ability to utilize multiple attachments, 2 (or more) attachments/accessories per rope (with Prusik cord) for a total of four (4) (or more) attachments.

Numerous attachment options.

Individual can make use of support for static or dynamic resistance utilizing the various attachments or accessories.

Can be utilized for gross motor as well as core stabilization.

Can be utilized for decompression of the spine and other joints.

Whole body supported and unsupported suspension.

Can be applied in rehabilitative settings.

A spring attachment, being dynamic, provides even tension within a full range of motion for those who do not choose to utilize their entire body weight in a static environment.

The dynamic option removes the vertical force of gravity from the exercise or stretch creating the ability to use more or less support instead of being committed to utilizing only the person's body weight. The dynamic option for increasing support is safer for individuals that are injured or de-conditioned. The dynamic option for decreasing support creates extra challenges in balance and stabilization for highly conditioned users.

The support belt attachment or accessory allows for decompression or traction.

"Slide-lok" locking mechanism is reliable and superior to others in terms of functionality and safety.

"Slide-lok" is adjustable on both sides and allows complete flexibility to accommodate users of all sizes.

"Rope Clamp" is superior securing the loops with stitching.

"Rope Clamp" secures a loop for attaching all accessories rather than having a permanently sewn fabric foot loop.

Anchor points above and below are possible (superior and inferior) with dynamic movement in between the two anchor points. The body itself would be the inferior anchor and the spring or elastic connected to the loops would be where the dynamic movement happens.

The use of two (2) ropes allows for an unlimited number of exercises and stretches in all planes of movement.

Allows for up to four (4) (or more) various attachments or accessories, 2 (or more) on each rope (with Prusik cord) allowing the user to engage all four (4) limbs and torso simultaneously.

Attachment or accessory kits may be tailored to athletic or rehabilitative needs.

We claim:

1. A physical training and rehabilitative suspension system, comprising:

a rope having first and second sides that hang downwardly from a bar, beam or other support, the rope terminating in first and second ends, respectively;

a locking mechanism having first and second sections to receive the first and second rope sides, respectively, each section being independently adjustable between an unlocked position, wherein the rope side associated with that section can slide through the locking mechanism, and a locked position, wherein the rope side associated with that section is prevented from sliding;

a connector disposed at the first end of the rope forming a loop for connection to an attachment or accessory and wherein each section of the locking mechanism is independently adjustable between an unlocked and locked position with a separate lever.

2. The physical training and rehabilitative suspension system of claim 1, wherein the connector is a body through which the first end is clamped to form the loop.

3. The physical training and rehabilitative suspension system of claim 1, further including a Prusik cord to form a moveable loop along the second side of rope for connection to an attachment or accessory.

4. The physical training and rehabilitative suspension system of claim 1, wherein the attachments or accessories include one or more of the following:

a loop, a sling, a rigid bar, a spring, a support belt, and a handle.

5. The physical training and rehabilitative suspension system of claim 1, including:

a pair of ropes, each terminating in a loop-forming connector; and a pair of locking mechanisms.

6. The physical training and rehabilitative suspension system of claim 5, further including a bar, beam or other support.

7. A kit for physical training or rehabilitation or other applications, comprising:

a rope having first and second sides that terminate in first and second ends, respectively, one of the ends including a loop-forming connector;

a locking mechanism having first and second sections to receive the first and second rope sides, respectively, each section being independently adjustable between an unlocked position, wherein the rope side associated with that section can slide through the locking mechanism, and a locked position, wherein the rope side associated with that section is prevented from sliding;

at least one snap hook or carabineer; and at least one attachment or accessory configured for coupling to the loop-forming connector using the snap hook or carabineer.

8. The kit of claim 7, wherein the attachment or accessory is a loop.

9. The kit of claim 7, wherein the attachment or accessory is a sling.

10. The kit of claim 7, wherein the attachment or accessory is a rigid bar.

11. The kit of claim 7, wherein the attachment or accessory is a spring.

12. The kit of claim 7, wherein the attachment or accessory is a support belt.

13. The kit of claim 7, wherein the attachment or accessory is a handle.

14. The kit of claim 7, further including:

a Prusik cord to form a moveable loop along the second side of rope; and at least two snap hooks or carabineers.

* * * * *